US005136810A

United States Patent [19]

DeWitt, III

[11] Patent Number: 5,136,810

[45] Date of Patent: Aug. 11, 1992

[54] PARKING GATE

[76] Inventor: Frank A. DeWitt, III, 2365 Cox Rd., Holcomb, N.Y. 14469

[21] Appl. No.: 707,625

[22] Filed: May 30, 1991

[51] Int. Cl.[5] ..... E01F 13/00; E05F 15/10

[52] U.S. Cl. ..... 49/49; 49/28; 49/141

[58] Field of Search ..... 49/49, 28, 35, 141

[56] References Cited

U.S. PATENT DOCUMENTS

| | | | |
|---|---|---|---|
| 3,195,879 | 7/1965 | Bond et al. | 49/28 X |
| 3,626,637 | 12/1971 | Rudicel | 49/49 X |
| 3,686,794 | 8/1972 | Sakamoto et al. | 49/49 X |
| 3,791,072 | 2/1974 | Miller | 49/141 |
| 3,975,861 | 8/1976 | Baump et al. | 49/28 |
| 4,490,068 | 12/1984 | Dickinson | 49/49 X |
| 4,523,513 | 6/1985 | Gudat et al. | 49/28 X |
| 4,658,543 | 4/1987 | Carr | 49/49 X |
| 4,681,479 | 7/1987 | Wagner et al. | 49/49 X |
| 4,901,071 | 2/1990 | Fletcher | 49/49 X |

*Primary Examiner*—Philip C. Kannan
*Attorney, Agent, or Firm*—Howard J. Greenwald

[57] ABSTRACT

A pneumatically-powered traffic control gate is disclosed. This gate contains a cylinder and piston for raising and lowering its gate arm, a means for adjusting the alignment of the traffic gate arm, a pneumatic means for sensing the presence of an obstruction to the movement of said traffic gate arm, and a means for reversing the movement of the piston and the gate once the obstruction has been sensed.

16 Claims, 4 Drawing Sheets

PARKING GATE

FIELD OF THE INVENTION

A parking gate which is operated by pneumatic means is described.

BACKGROUND OF THE PRIOR ART

Parking gates are well known to the prior art. Thus, by way of illustration, U.S. Pat. No. 3,993,975 of Long et al. claims a parking lot gate which is comprised of (1) electrically operated drive means provided with a first drive means energizing circuit including the contacts of normally deenergized first relay means, (2) normally open first cam switch means coupled to the gate bar and closing in response to the initial operation of the drive means, (3) second relay means controlled by said clearance device, (4) normally closed second cam switch means coupled to the gate bar, (5) a first circuit connected to said first relay means for momentarily energizing same and including the contacts of said second relay means and said normally closed second cam switch means, and (6) a second circuit connected to said first relay means for energizing same and including said first cam switch means.

The parking gate described in the Long et al. patent, in addition to containing relatively complicated electrical circuits, is also mechanically complicated. It is comprised of (1) a down limit switch, (2) an up limit switch, (3) a three-phase alternating current motor, (4) high-current, motor reversal relays, (5) a gear box, (6) belts, (7) two pulleys, (8) a clutch, and (9) linkages to detect the parking gate arm hitting an obstruction.

The Long et al. parking gate is typical of other parking gates commonly used in the industry. It is complicated, expensive, difficult to service, unreliable, and moderately dangerous to service because of the use of relatively high voltage in its electrical circuits.

It is an object of this invention to provide a parking gate which contains substantially fewer parts than prior art parking gates.

It is another object of this invention to provide a parking gate which is substantially more reliable than prior art parking gates.

It is yet another object of this invention to provide a parking gate which has a substantially longer service life than the prior art parking gates.

It is yet another object of this invention to provide a parking gate which does not contain any high-voltage circuitry.

It is yet another object of this invention to provide a parking gate which consumes substantially less energy in its operation than prior art parking gates.

It is yet another object of this invention to provide a parking gate comprised of means for providing more power to the arm of the gate when it is first being raised than later in its raise cycle;

It is yet another object of this invention to provide a parking gate comprised of means for lowering said gate and safety means for limiting the amount of power used in lowering said gate;

It is yet another object of this invention to provide novel means for detecting obstructions which the arm of the parking gate encounters;

It is yet another object of this invention to provide a novel clamp for attaching the arm of the gate to the gate.

SUMMARY OF THE INVENTION

In accordance with this invention, there is provided a traffic control gate for controlling the flow of traffic through a lane comprised of pneumatic actuating means, a gate arm of readily fracturable material, and gate clamping means for attaching said gate arm to the pneumatic actuating means.

BRIEF DESCRIPTION OF THE DRAWINGS

The present invention will be more fully understood by reference to the following detailed description thereof, when read in conjunction with the attached drawings, wherein like reference numerals refer to like elements, and wherein.

DESCRIPTION OF THE PREFERRED EMBODIMENTS

Figure 1:
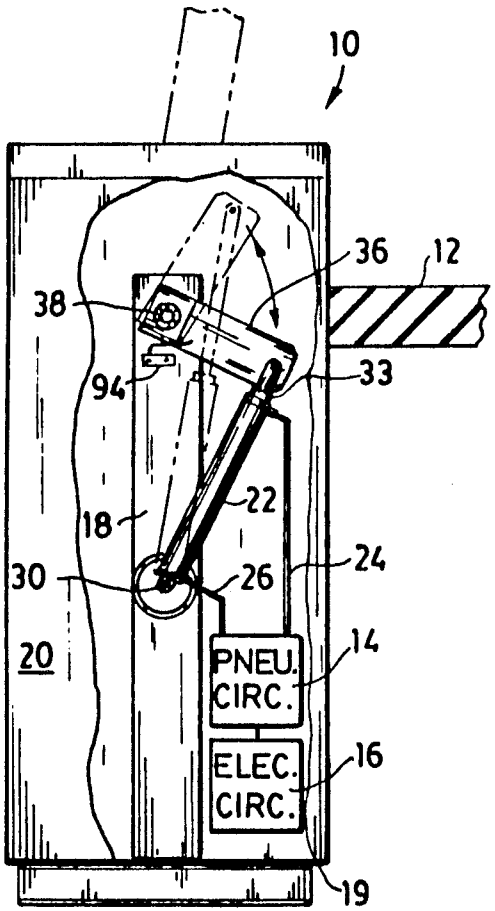
FIG. 1 is a partial, front sectional view of one preferred embodiment of applicant's invention.

One preferred embodiment of the parking gate of this invention is illustrated in FIG. 1. Referring to FIG. 1, it will be seen that parking gate 10 is preferably comprised of gate arm 12, pneumatic actuating means 14, electrical control means 16, support means 18, base 19, and body 20.

Gate arm 12 is well known to those skilled in the art and is described and/or illustrated, e.g., in "Parking," Volume 30, Number 1 (National Parking Association, Washington, D.C.), the disclosure of which is hereby incorporated by reference into this specification. Gate arm 12 preferably consists of a readily fracturable material, such as wood, plastic pipe, and the like. The fracturable materials are well known in the parking gate art and are described, e.g., in U.S. Pat. No. 3,791,072 of Miller. Wood is the most preferred fracturable material, and it is thus preferred that gate arm 12 generally have an elongated and substantially flat configuration. In one embodiment, a pine wood which is from 4 to about 10 feet long, about 3.25 to about 4 inches wide, and 0.5 to about 0.75 inch thick is used.

Referring again to FIG. 1, it will be seen that gate arm 12 is operatively connected to pneumatic actuating means 14. In the embodiment illustrated in FIG. 1, pneumatic actuating means 14 is comprised of an air cylinder 22 which is connected by flexible tubes 24 and 26 to pneumatic circuit 14. The air cylinder 22 is preferably pivotally mounted at its end 30 by a clevis and a fixed pin (not shown in FIG. 1). End 33 of air cylinder 22 is connected to parking gate arm 12.

Air cylinders are well known to those skilled in the art, and substantially any of these prior art air cylinders may be used. Thus, for example, one may use an air cylinder identified as "No. 178 DUZ" which is described on page 65 of the Bimba Manufacturing Company catalog (catalog OL-989-B), which was published in 1989. This cylinder, which has a stroke of 8.0 inches, is a universal mount, double acting cylinder.

Referring again to FIG. 1, it will be seen that air cylinder 22 and gate arm 12 are both pivotally connected to support 18. Support 18 may be any conventional means which is substantially rigid. In the embodiment illustrated in FIG. 1, support 18 is a steel tube which, preferably, is about 4.0 inches square with wall thickness of about 0.25 inches. This steel tube 18 is preferably welded and gusseted to a base 19 which, in the embodiment of FIG. 1, is preferably ¼" steel.

Figure 3:
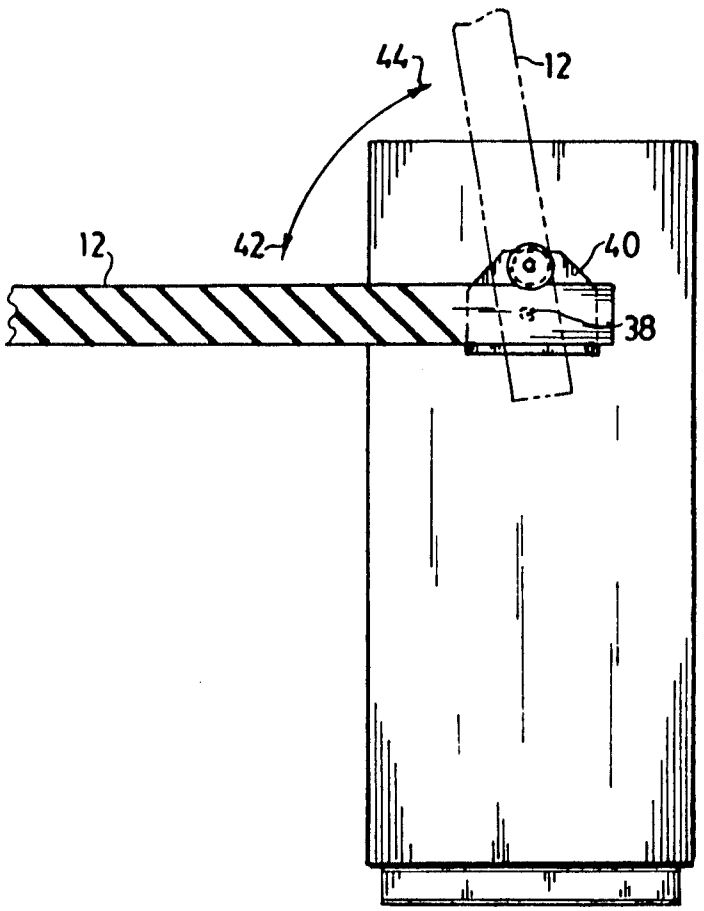
FIG. 3 is a back view of the embodiment of FIG. 1.
Figure 2:
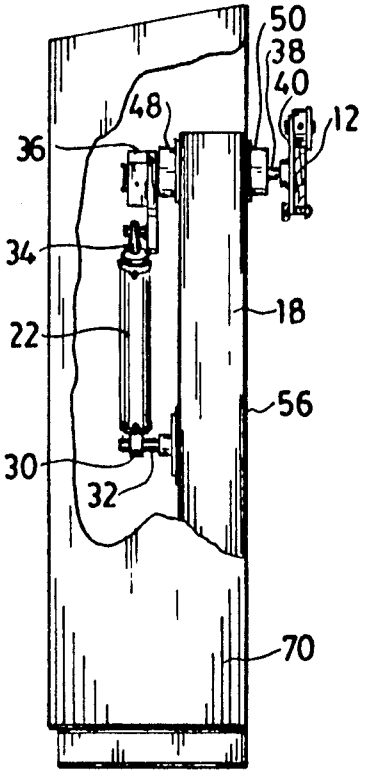
FIG. 2 is a partial, side sectional view of the embodiment of FIG. 1.

The body 20 enclosing applicant's parking gate apparatus may consist of any body material conventionally used in prior art parking gate apparatuses. It is preferred that body 20 consist essentially of steel. Any other body which provides protection against vandals and weather may also be used. As is illustrated in FIGS. 2 and 3, it is preferred that certain portions of body 20 be removable so that access may readily be gained to the working parts of the parking gate apparatus. In another embodiment, not shown, the body 20 is comprised of a door through which access to the working parts of the apparatus may be gained. Such a body is illustrated, e.g., on page 16 of the January-February, 1991 issue of "Parking."

A preferred means for pivotally attaching the air cylinder 22 to both the support 18 and the parking gate arm 12 is illustrated in FIG. 2. Referring to FIG. 2, it will be seen that end 30 of air cylinder 22 is pivotally attached to support 18 by means of pivot 32.

Referring to FIG. 2, it will be seen that pivot pin 32 is attached to base 18 by conventional means. In one embodiment, it is preferred to attach pivot pin 32 to base 18 by screwing the threaded end of pivot pin 32 (not shown) into a threaded receptacle in support 18 (not shown) adapted to receive said threaded end.

Any of the pivot pins known to the art may be used as pivot pin 32.

The end 33 of air cylinder 22 is preferably pivotally connected to gate arm 12 by means of a spherical bearing female rod end 34 which contains a stud. This rod end may be obtained, e.g., as part number CW-7S from the Aurora Bearing Company of Aurora, Ill. 60506; see, e.g., page 23 of Aurora's catalog number 590, published in 1990, which describes "CW-S and CG-S Series Female Rod With Studs."

Referring again to FIG. 2, it will be seen that female rod end 34 is pivotally connected to crank arm 36 by means of a threaded hole (not shown). Crank arm 36 preferably consists of metal, such as, e.g., steel.

Crank arm 36 is connected to a shaft 38 which, in turn, is connected to gate arm clamp 40. The gate arm clamp 40 is, in turn, connected to gate arm 12. Thus, as cylinder 22 extends upwardly, it causes crank arm 36 to pivot, thereby causes shaft 38 to rotate, and thereby causes gate arm 12 to move.

FIG. 3 shows the gate arm 12 in the barrier position (after it has finished movement in the direction of arrow 42) and also, at the other extreme, in the open position (after it has finished movement in the direction of arrow 44).

Figure 4:
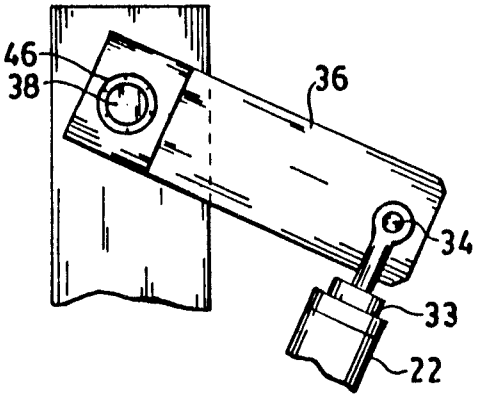
FIG. 4 is a partial view of the actuating means of the embodiment of FIG. 1.

FIG. 4 is a partial sectional view illustrating a preferred means for connecting shaft 38 to crank arm 36. In this preferred embodiment, shaft 38 is connected to crank arm 36 by a mechanical friction joint. A suitable orifice (not shown) is bored into crank arm 36, the mechanical friction joint 46 is inserted into said bore, the gate arm 12 is attached and clamped to shaft 38 (preferably using clamp 40), and shaft 38 is then aligned with and connected to mechanical friction joint 46.

Any of the mechanical friction joints 46 known to those skilled in the art may be used. Thus, by way of illustration, one may use part SKF-SHR-1, which is described on page 10 of the SKF Component Systems Co. catalog No. 3763 U.S. (published in 1988 by SKF Component Systems Company, 1530 Valley Center Parkway, Lehigh Valley Corporate Center, Bethlehem, Pa.) Because this friction joint allows the alignment shaft 38, the alignment of gate 12 can thus be adjusted. Thus, because of the use of this component, applicant's apparatus preferably comprises means for adjusting the alignment of the gate arm 12.

Other means for adjustably attaching gate arm 12 to shaft 38 also may be used in applicant's device. Thus, for example, one use a clamp 40 (see FIG. 1) which is oversize and which allows adjustment of the position of gate arm 12 within the confines of clamp 40. Thus, for example, the means illustrated in FIG. 2 of U.S. Pat. No. 3,975,861 (the disclosure of which is hereby incorporated by reference into this specification) also may be used.

Figure 5:
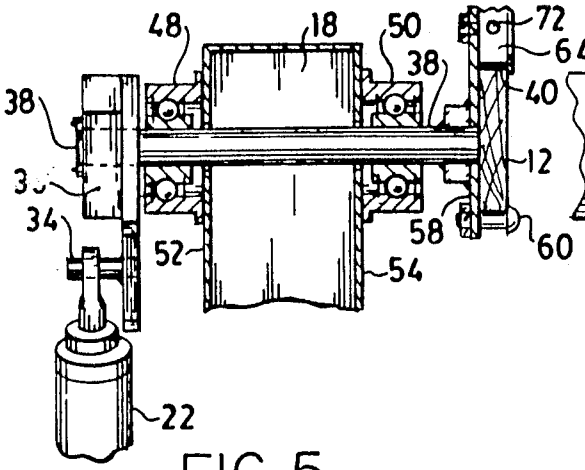
FIG. 5 is a side view of the actuating means of FIG. 4.

FIG. 5 illustrates a means of providing support for shaft 38. Referring to FIG. 5, it will be seen that shaft 38 extends through an orifice (not shown) in support 18. In the embodiment shown in FIG. 5, bearing assemblies 48 and 50 support and facilitate the rotation of shaft 38. In this embodiment, the bearing assemblies 48 and 50 are preferably flange bearings which are attached by conventional means (such as bolts) to the exterior walls 52 and 54 of support 18. Referring to FIG. 2, it will be seen that, in the embodiment of this Figure, bearing assembly 52 is connected through the back wall 56 of body 20.

In one preferred embodiment, each of bearing assembles 48 and 50 are flange bearings. Any of the flange bearings known to those skilled in the art may be used. Thus, for example, one may use a 1.0 inch 4 hole flange mount bearing identified as "MC Gill KFC4-45-1 in Catalog 89 of McGill Precision Bearings (McGill Manufacturing company, Inc., Bearing Division, Valparaiso, Ind.), at page 142 of such catalog. Many of the other bearings described in the McGill catalog also may be used.

Figure 6:
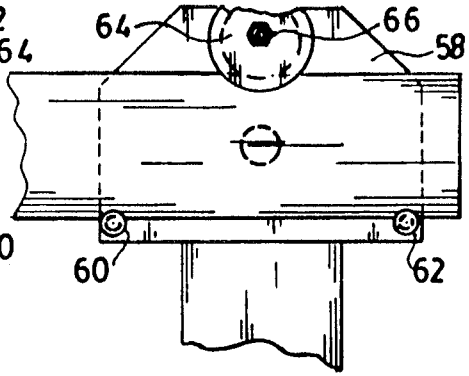
FIG. 6 is partial view of the embodiment of FIG. 3, illustrating the preferred means for attaching the gate arm to the actuating means of the embodiment of FIG. 1.
Figure 9:
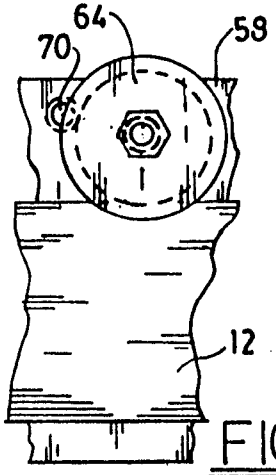
FIGS. 7, 8, and 9 illustrate how the attachment means of FIG. 6 may be utilized with different thicknesses of fracturable gate arms.
Figure 8:
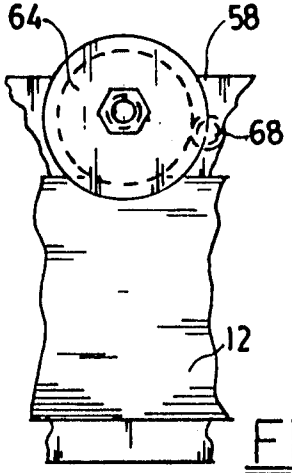
Figure 7:
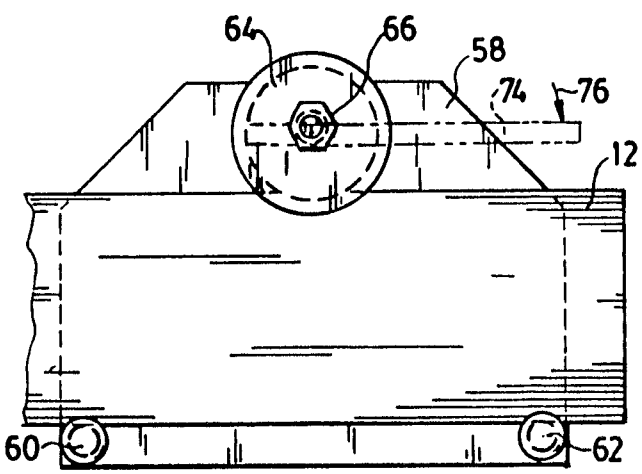

FIG. 5 also illustrates the structure of clamp 40. Referring to FIGS. 5 and 6, it will be seen that such clamp 40 is comprised of plate 58, carriage bolts 60 and 62, eccentric cam 64, and a bolt 66 which serves as a pivot for the eccentric cam 64. The operation of clamp 40 is illustrated in FIGS. 7, 8, and 9.

Eccentric cam 64 is mounted on bolt 66. There are preferably at least three orifices (not shown in FIG. 7) extending through plate 58. One of these orifices (orifice 68) is partially shown in FIG. 8; and another of these orifices (orifice 70) is partially shown in FIG. 9. As will be apparent to those skilled in the art, the choice of which orifice bolt 66 is passed through will influence the placement of cam 64 and, consequently, the width of the gate arm 12 which may be disposed between said cam 64 and carriage bolts 60 and 62.

One common peril faced by many parking gates is the ire of some motorists who fail to stop when the gate is in its down position; another common peril is vandalism. Because of these perils, it is often necessary to replace gate arm 12. Because applicant's gate arm 12 is removably attached to clamp 40, it is relatively easy to remove a broken gate arm 12 and replace it with a new one.

Referring to FIG. 5, it will be seen that clamp 40 preferably is comprised of an orifice 72 into which a tool 74 (see FIG. 7) is adapted to be inserted. Once tool 74 is so inserted, it may be moved in the direction of arrow 76, thereby rotating cam 64 ia clockwise direction and embedding it into the fracturable wood of gate arm 12. Alternatively, when tool is moved ia direction opposite to that of arrow 76, the grip of cam 64 on gate arm 12 is loosened, and such gate arm can be removed from the assembly.

Referring again to FIG. 1, it will be seen that parking gate 10 is comprised of both electrical control means 16 and pneumatic control means 14 for controlling the movement of gate arm 12. One preferred electrical control means is illustrated in FIG. 10.

Figure 10:
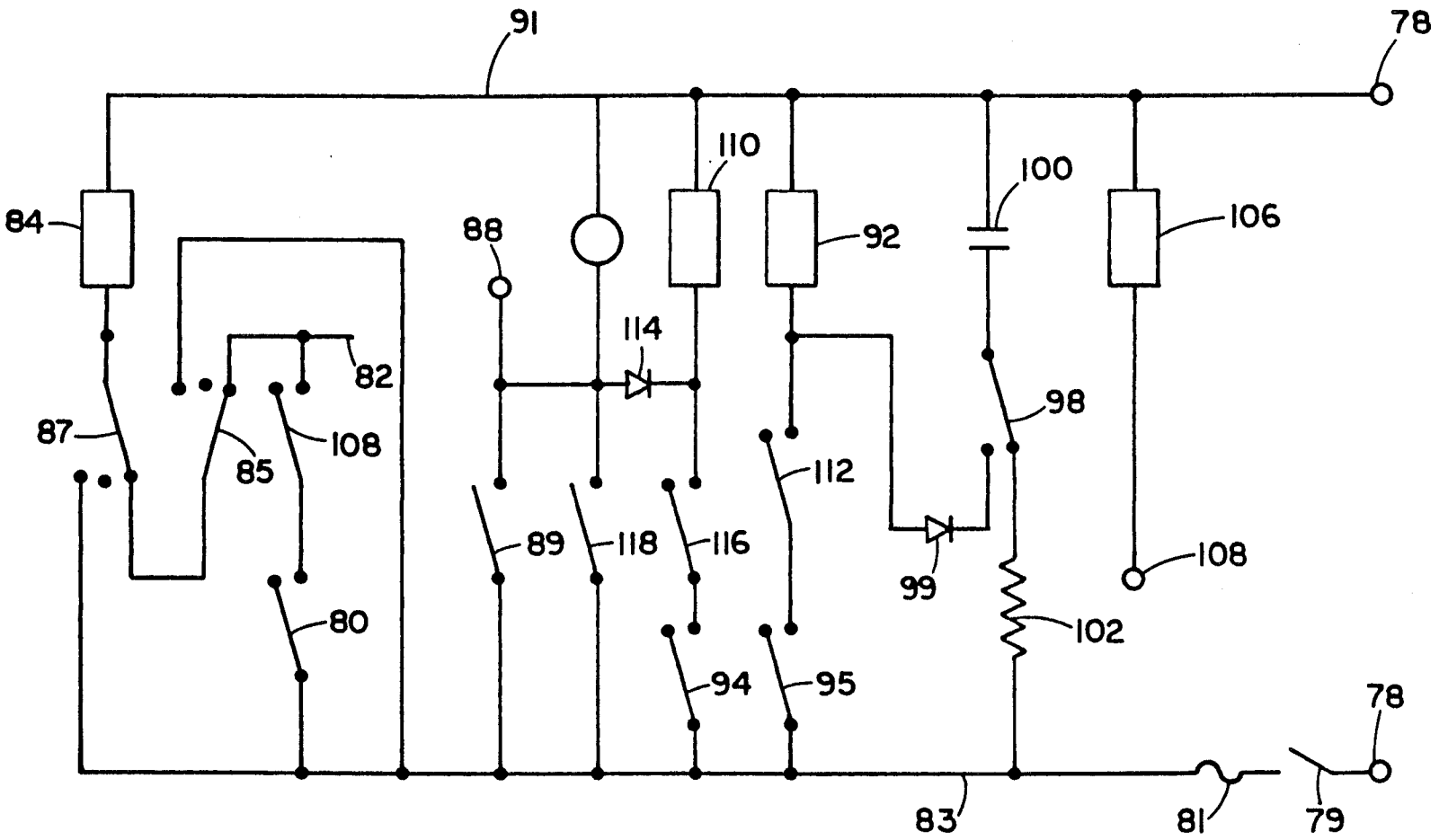
FIG. 10 is a schematic of one preferred electrical circuit which may be used in the embodiment of FIG. 1.

Referring to FIG. 10, electrical control means is comprised of a source of low voltage direct current 78. It is preferred that said source of low voltage direct current provide from about 20 to about 30 volts of direct current and, more preferably, from about 23 to about 26 volts of direct current.

In the preferred embodiment illustrated in FIG. 10, switch 79 and fuse 81 are disposed between terminal 78 and bus wire 83 in order to control the power supplied to the circuit and to protect the power supply.

Any means for providing the required low-voltage direct current may be used as means 78. Thus, by way of illustration, one may use a power supply to convert the 115 volt alternating current commonly available to 24 volt direct current.

Referring again to FIG. 10, a signal will be fed to terminal 82 to apply voltage to such terminal, thus allowing current to flow through manual control switches 85 and 87 (which are located inside of and outside of gate 10, respectively, the outside switch 87 preferably being key operated) to relay 84; one such preferred relay is a 24 volt direct current relay, identified as part number K10P11D15 at page 54 of the Masline Electronics Inc. catalog. Any conventional means may be used to cause terminal 82 to receive a 24 volt signal from an outside control device. Thus, e.g., one may use a ticket dispenser, a card reader, a loop detector, and/or another suitable signal generating devices commonly used in parking gates.

In one embodiment, the signal provided to terminal 82 is produced by a model 1016 loop detector available from Detector Systems, Inc., 11650 Seaboard Circle, Stanton, Calif.

In another embodiment, the signal provided to terminal 82 is produced by an LR5 Card Reader produced by the American Parking Equipment Company of 6836 Stroud Road,Cleveland, Ohio 44130. In another embodiment, such signal is produced by a TD 249 Ticket Spitter produced by said American Parking Company.

Once terminal 82 has a suitable direct current signal as the result of a suitable external input, current flows through it to relay 84. The function of relay 84 is to close contact 89 and allow current to flow to terminal 88. The current passing through terminal 88 is fed to input 92 of pneumatic valve 96 of pneumatic circuit 14 (see FIG. 11); input 94 is connected to common 91.

Relay 84 is kept in an energized state by its relay contact 80 and, additionally, by relay 106's contact 108. As will be apparent to those skilled in the art, to lower gate 12 a signal is applied to point 108 and, thereafter, energizes relay 106, which, in turn, causes relay 84 to deenergize, thereby removing current from valve 96 and allowing the gate to lower.

As will be apparent to those skilled in the art, all of the circuitry necessary to raise or lower gate arm 12 is contained in components 80, 84, 85, 87, 89, and 106.

The remainder of the circuit of FIG. 10 provides a means of reversing the movement of the gate arm 12 when it hits an obstruction. Referring again to FIG. 10, relay 92 is closed by switch 95, by relay 110's contact 112, under a specified set of conditions. Relay 92 is preferably the same as relay 84.

Relay 110 is closed by the signal resulting from relay 84 closing contact 89, causing current to flow through diode 114. Once relay 110 has been energized, it will remain energized by switch 94 and relay 92's contact 116, until gate arm 12 is completely lowered, at which point switch 94 is opened.

Referring to FIG. 1, switch 94 is a normally closed switch which will be open only when crank arm 38 is completely down. Thus, as long as gate arm 12 is not in its barrier position, switch 94 is closed.

Figure 11:
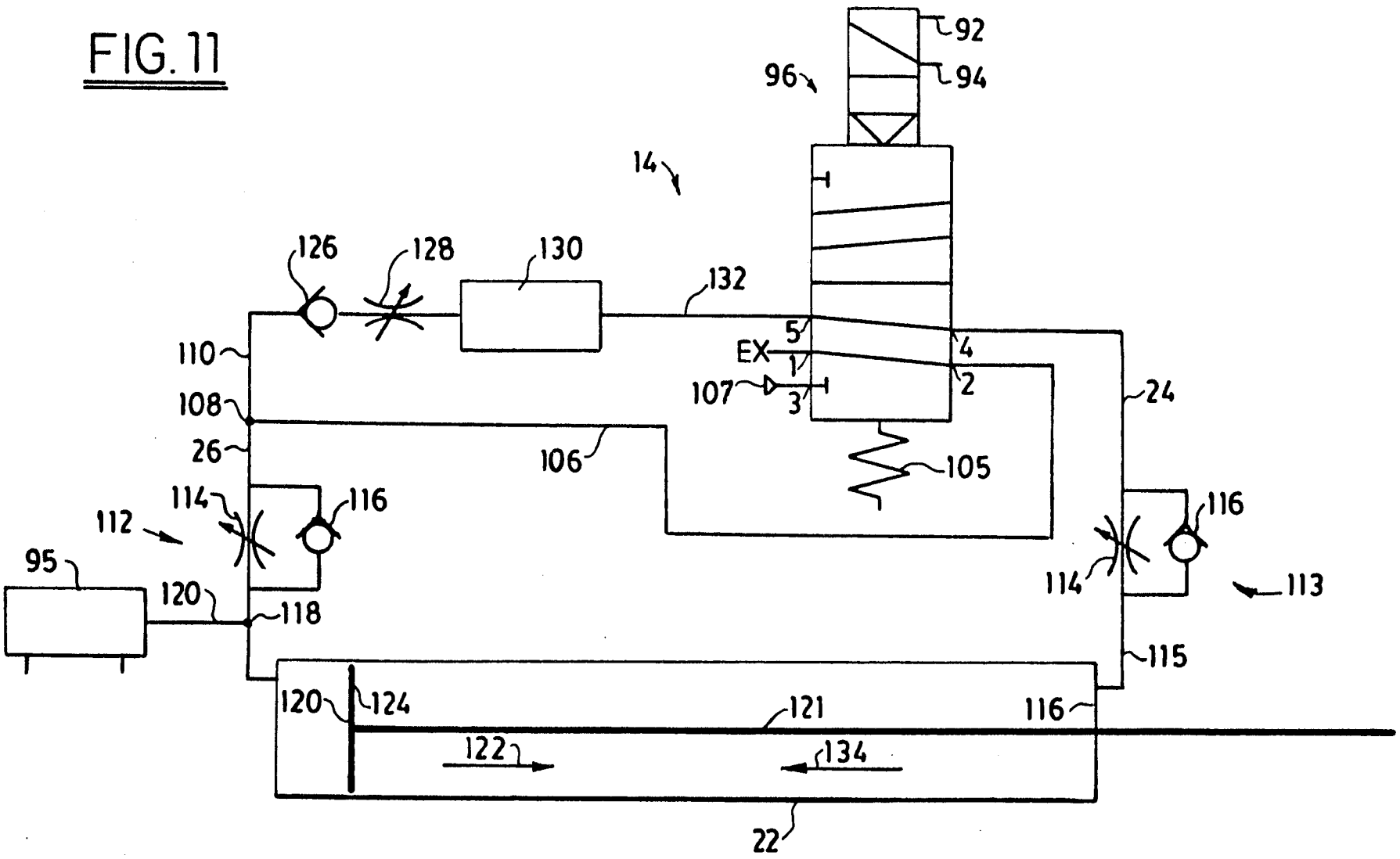
FIG. 11 is a schematic of one preferred pneumatic circuit which may be used in the embodiment of FIG. 1.

Referring to FIG. 11, switch 95 is a pressure switch which is closed when air pressure ceases to be applied to it. Such switches are commonly available and may be obtained, e.g., as part number F-4100-100 from Air Logic Company of 5102 Douglas Avenue, Racine, Wis.; see, e.g., Publication 9000 of said company (published in 1990), at page 3. As will be seen from such publication, the switch 95 may be adjusted so that it closes at a specified pressure (from 0 to 15 p.si.) or at no pressure.

Referring again to FIG. 11, it will be seen that air cylinder 22 is operatively connected to switch 95 via line 120. When the air pressure in air cylinder 22 is substantially zero, switch 95 closes.

Referring again to FIG. 10, only when both switch 95 and relay 110's contact 112 close is current delivered to relay 92. Thus, only when both there is substantially no pressure in the lower end 30 of air cylinder 22, and when gate arm 12 is not in its barrier position, and gate arm 12 has been caused to raise by current flowing to valve 96, will current be delivered to relay 92. This situation only can occur in applicant's device when gate arm 12 has encountered an obstruction after being raised by current flowing to valve 96.

Referring again to FIG. 10, when relay 92 has been energized, its contact 118 causes the air valve 96 to be energized, thereby raising the gate. The closing of contact 98 will cause relay 92 to stay in its closed position for only a specified period of time, until capacitor 100 has been discharged through contact 98 and diode 99; diode 99 and/or diode 114 may be 1N1004 type diodes which are commonly available. Capacitor 100 preferably is a 2,000 microfarad 50 volt capacitor which, when contact 98 is normally closed, will charge through resistor 102 to the value of the direct current applied across terminals 78. Current limiting resistor 102 preferably has a resistance of 500 ohms and a power rating of 0.25 watts.

Once capacitor 100 has been discharged, then relay 92 will open again. With the arrangement of the preferred components, the relay will stay closed for about 3.0 seconds. It will be appreciated by those skilled in the art however, that the relay may be kept closed for different amounts of time by choosing a capacitor with a different capacitance and/or a relay with a different resistance.

Thus, when the pressure in end 30 of air cylinder 22 is substantially zero, the gate arm 12 will be raised and be maintained in its raised position for a specified period of time, preferably about 3.0 seconds.

FIG. 11 illustrates a preferred pneumatic control means 14 which, in concert with electrical control means 16, controls the movement of gate arm 12.

Referring to FIG. 11, compressed air 107 at a pressure of from about 35 to about 70 pounds per square inch gage is provided to four-way five-port valve 96. The function of valve 96 is to selectively transfer air upon being activated by an electrical signal.

Electrically-activated pneumatic valves are well known to those skilled in the art and are readily available. Thus, for example, the aforementioned four-way five port valve 96 may be obtained as part number L0702AAWR from the Automatic Valve Company of Novi, Mich.; see, e.g., 4 of publication AV-1926, published in 1990. This particular valve, in its unenergized state, has port 3 closed, port 1 connected to port 2, and port 5 connected to port 4; this unenergized state is shown schematically in FIG. 11. In its energized state, this valve has port 3 connected to port 2, port 1 connected to port 4, and port 5 closed. When valve 96 is energized by the electrical signal, a solenoid 109 causes the valve to move. Conversely, when valve 96 is deenergized, the spring 105 causes it to move in the opposite direction.

In one preferred embodiment, not shown, pneumatic circuit 14 is provided with an air regulator which insures that the compressed air delivered to valve 96 is maintained at a specified pressure such as, for example, 40 pounds per square inch. These air pressure regulators are well known to those skilled in the art. Thus, for example, one may use the "Arrow 7602 Miniature Integral Filter Regulator" which is described on page 13 of catalog No. X2008 of the Arrow Pneumatics, Inc. of 500 North Oakwood Road, Lake Zurich, Ill..

When valve 96 is unenergized, the air supplied to it at a preferred substantially constant pressure has nowhere to go. In this state, no air is used, no power is used, no motion occurs.

When an electrical signal is applied to terminals 92 and 94 from the electrical circuit of FIG. 10, however, the valve 104 is energized, and this valve 104 then has port 3 connected to port 2, port 1 connected to port 4, and port 5 closed. In this state, the air then flows through valve 96, into port 3, out port 2, and through line 106 to point 108. At point 108, the air can then flow in two directions, through line 26, and/or through line 110.

The air flowing through line 26 will attempt to flow through adjustable quick flow control 112. This control 112 is comprised of both an adjustable needle valve 114 and a check valve 116. These adjustable quick flow controls are readily available as, e.g., part number FQP2 from Bimba Manufacturing Company (see page 9 of the aforementioned Bimba catalog OL-989-B). Pneumatic control valves are described, in general, in Charles S. Hedges, "Industrial Fluid Power," Volume 1 (High Tech Power and Control, Inc., Rochester, N.Y.), the disclosure of which is hereby incorporated by reference into this specification.

As is illustrated in FIG. 11, the quick flow control device 112 is comprised of an adjustable needle valve. The rate of flow of air through valve 114 may be adjusted, thereby adjusting the rate of flow exiting from air cylinder 22. When air is filling air cylinder 22, needle valve 114 is bypassed, and air flows through check valve 116. This is the case because the air will tend to take the path of least resistance, and it will be substantially easier for it to flow through the check valve than the needle valve.

The air passing through control device 112 will flow past point 118; a portion of said air will flow into pressure switch 95, which will remain open as long as it senses the presence of some air pressure in line.

The air flowing past point 118 will enter hydraulic cylinder 22, and will cause piston 120 to move in the direction of arrow 122. Rod 121 of piston 120 is operatively connected to crank arm 36, and its movement in the direction of arrow 122 raises gate arm 12.

The speed at which piston 120 travels may be regulated by the use of a quick flow control device 113, which may be similar or identical to the quick-flow control device 112. Control device 113 regulates the speed at which air may pass from cylinder 22, through line 115, and then through line 24 back to port 4. Port 4 is connected to port 1, allowing this air to vent to atmosphere.

As will be apparent to those skilled in the art, when piston head contacts interior wall 116 of air cylinder 22, the movement of piston 120 ceases, and the air flow into the piston ceases. No intervention by external means is required to achieve this stop state; thus, no external limit switch, brake, or relay is required to stop the movement of the piston.

The piston 120, once it has reached its stop state, will stay in the stop state as long as the air pressure and electricity are applied to valve 96.

Referring again to FIG. 11, the air at point 108 also flows through line 110 through check valve 126 and adjustable needle valve 128. Any conventional needle and check valves may be used as components 128 and 126. Thus, for example, one may use in-line check valve HJC1 and in-line needle valve HJN1) sold by the Hi-Tech Power and Control Inc. of Rochester, N.Y.) The pressurized air passing through valves 126 and 128 fill accumulator 130.

Needle valve 128 is adjustable, and it is adjusted so that air will flow more readily to air cylinder 22 than to accumulator 130. It is preferred to adjust needle valve 128 so that the accumulator takes substantially as long to reach the desired air pressure as does the piston 120 to travel its full length.

The function of accumulator 130 is to store air pressure during the up cycle, to be used during the down cycle. These accumulators are well known in the art. Thus, e.g., one may use Bimba air reservoir No. D-5096-a-1.5, which is described on page A68 of the aforementioned Bimba catalog.

Thus, when gate arm 12 has been raised to its up position, accumulator 130 is preferably filled with pressurized air. The gate arm 12 will continue to stay in its up position as long as an electrical signal continues to be present at terminals 92 and 94.

Referring again to FIG. 10, an electrical signal will be present at terminals 92 and 94 only as long as either (1)relay 84 is energized by an external source (such as the ticket spitter, or the loop detector, or the card reader described above, or (2)relay 92 is energized, when an obstruction is encountered by gate arm 12 when gate arm is moving from its up to its down position.

Thus, after the external input to terminals 80 and 82 ceases, relay 84 deenergizes, relay contact 86 opens, and electrical power ceases to flow to terminals 92 and 94. This causes four-way-five port air valve 96 to revert to its deenergized state, in which the air 107 supplied to valve 96 has no place to go.

When the valve 96 is deenergized, the air present in accumulator 130 can only flow in the direction of line 132, into port 5 and out port 4; flow in the direction of line 110 is prevented by check valve 126.

The air flowing out of port 4 passes through line 24 and through check valve 116, and then to line 115, and then to cylinder 22, where it will contact the head 124 of piston 120 and push it in the direction of arrow 134. A sufficient amount of air will be provided to piston 120 to start its movement in the downward direction; the force of gravity will tend to continue the movement of the piston in the downward direction.

The speed at which piston 120 travels in the downward direction may be controlled by adjustable needle valve 114, which controls the rate of flow of air which exits the cylinder during the downward motion; because the flow is being restricted by needle valve 114, some pressure remains in cylinder 22 until the piston has fully reached the down position. The pressure present in the cylinder is caused by the downward movement of the piston 20 and the restriction imposed to air flow by needle valve 114; and it is sensed by pressure sensor 95. However, once the downward movement of piston 120 ceases for any reason, the pressure created by its movement ceases, and no pressure will be sensed by pressure sensor 95.

Thus, when gate arm 12 is moving downward and its movement is interrupted by an obstruction (such as, e.g., a car), the sensor 95 will cease to sense pressure. When sensor 95 ceases to sense pressure, switch 91 closes; and, as long as gate arm 12 is not all the way down, then switch 93 is closed, relay 92 is activated, and a electrical signal will again be furnished to terminals 92 and 94, thereby again activating control means 114 and raising the gate. As indicated above, this signal will be provided only for a specified time (such as, e.g., 3.0 seconds), after which the gate arm 12 will again descend.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

Thus, by way of illustration, one could use a comparable hydraulic system rather than a pneumatic system in applicant's device. It does not matter substantially whether the fluid used in applicant's system is air, a gas such as nitrogen, or liquid.

Thus, by way of further illustration, one may supply applicant's claimed gate with a backup battery which is adapted to provide from 20 to 30 volts of direct current. Thus, in case of a power failure, and/or a situation in which the gate must be used without a source of electricity which will feed the power supply normally present in the gate, the gate may still be operated adequately. To the same end, one may also supply the gate with a source of compressed fluid (such as, e.g., compressed air or nitrogen) to allow the gate to be used in circumstances where a compressor is not readily available or functional.

I claim:

1. A traffic control gate for controlling the flow of traffic through a lane, wherein said traffic control gate is comprised of:

(a) a traffic gate arm;

(b) fluid power means for furnishing power to and for raising said traffic gate arm to its open position and for lowering said traffic gate arm to its barrier position, wherein said fluid power means delivers the maximum amount of power to said traffic gate arm when said traffic gate arm begins to be raised and less power thereafter, wherein said fluid power means is comprised of a cylinder comprising a piston wherein said piston is adapted to move upon the introduction of fluid into said cylinder and wherein:

1. said cylinder is comprised of a front wall, a back wall, and a cylindrical casing,
2. said piston is operatively connected to said traffic gate arm,
3. said fluid power means is comprised of means for moving said piston until it contacts said front wall of said cylinder, thereby causing the movement of said traffic gate arm to cease in one position, and
4. said fluid power means is comprised of means for moving said piston until it contacts said back wall of said cylinder, thereby causing the movement of said traffic gate arm to cease in another position;

(c) means for adjusting the alignment of said traffic gate arm;

(d) means for sensing the presence of an obstruction to the movement of said traffic gate arm from its open position to its barrier position; and (e) means for reversing the movement of said piston once said obstruction has been sensed.

2. The traffic control gate as recited in claim 1, wherein said gate arm consists essentially of a readily fracturable material.

3. The traffic control gate as recited in claim 2, wherein said readily fracturable material is wood.

4. The traffic control gate as recited in claim 1, wherein said cylinder is a pneumatic cylinder.

5. The traffic control gate as recited in claim 1, wherein said means for sensing the presence of an obstruction is comprised of a pneumatic pressure sensor.

6. The traffic control gate as recited in claim 5, wherein said pneumatic pressure sensor is adapted to sense the amount of pressure in said pneumatic cylinder.

7. The traffic control gate as recited in claim 1, wherein said traffic control gate is comprised of electrical control means.

8. The traffic control gate as recited in claim 7, wherein said electrical control means comprise a source of from about 20 to about 30 volts of direct current.

9. The traffic control gate as recited in claim 1, wherein said fluid is air.

10. The traffic control gate as recited in claim 9, wherein said traffic control gate is comprised of electrical control means.

11. The traffic control gate as recited in claim 10, wherein said electrical control means comprise a source of from about 20 to about 30 volts of direct current.

12. The traffic control gate as recited in claim 1, wherein said traffic control gate is comprised of a power supply.

13. The traffic control gate as recited in claim 12, wherein said power supply provides a source of from about 20 to about 30 volts of direct current.

14. The traffic control gate of claim 13, wherein said traffic control gate is comprised of a source of compressed fluid.

15. The traffic control gate as recited in claim 1, wherein said gate is comprised of means for sensing when said gate arm is in its extreme up position and its extreme down position.

16. The traffic control gate as recited in claim 1, wherein said traffic control gate is comprised of means for adjusting the speed at which said traffic gate arm moves.

* * * * *